US005660576A

United States Patent [19]

Winga

[11] Patent Number: 5,660,576

[45] Date of Patent: Aug. 26, 1997

[54] TOY BALL

[76] Inventor: Justin R. Winga, 308 E. Burlington St. Suite 301, Iowa City, Iowa 52240

[21] Appl. No.: 635,017

[22] Filed: Apr. 19, 1996

[51] Int. Cl.[6] ..... A63H 33/00

[52] U.S. Cl. ..... 446/490; 446/491; 119/707; 473/575

[58] Field of Search ..... 446/450, 490, 446/491; 273/58 R, 58 C, 58 D; 119/702, 707, 708

[56] References Cited

U.S. PATENT DOCUMENTS

| | | | |
|---|---|---|---|
| 2,032,871 | 3/1936 | Dammeyer . | |
| 2,307,905 | 1/1943 | Ament . | |
| 3,476,086 | 11/1969 | Way . | |
| 3,727,583 | 4/1973 | Muraro | 119/707 |
| 3,731,927 | 5/1973 | Rocco, Jr. | 273/58 R |
| 4,321,888 | 3/1982 | Topliffe | 119/29 |
| 4,657,253 | 4/1987 | Lerner et al. | 273/58 C |
| 4,756,529 | 7/1988 | Stillinger | 446/490 |
| 4,813,674 | 3/1989 | Lorhpipat | 273/58 D |
| 4,867,451 | 9/1989 | Mitchell | 273/58 C |
| 4,884,807 | 12/1989 | Welch | 273/58 C |
| 5,092,272 | 3/1992 | O'Rourke | 119/29 |
| 5,186,457 | 2/1993 | Cole | 273/58 K |
| 5,224,959 | 7/1993 | Kasper | 446/26 |
| 5,265,559 | 11/1993 | Borell | 119/707 |
| 5,357,904 | 10/1994 | Takahashi et al. | 119/708 |
| 5,516,099 | 5/1996 | Strong | 273/58 C |

FOREIGN PATENT DOCUMENTS

| | | | |
|---|---|---|---|
| 4037847 | 4/1992 | Germany | 273/58 R |

*Primary Examiner*—Robert A. Hafer
*Assistant Examiner*—Jeffrey D. Carlson
*Attorney, Agent, or Firm*—James C. Nemmers

[57] ABSTRACT

A toy designed to entertain both humans and their pets. The toy is a continuous length of cord which has one end wrapped into a ball in such a way that the end is completely hidden in the ball so that the ball will not unravel. The other free end of the cord is relatively long and is used to spin the ball, throw it, tug it., etc. The toy is also made of a cord material that allows the toy to float on water.

4 Claims, 2 Drawing Sheets

FIG. 5
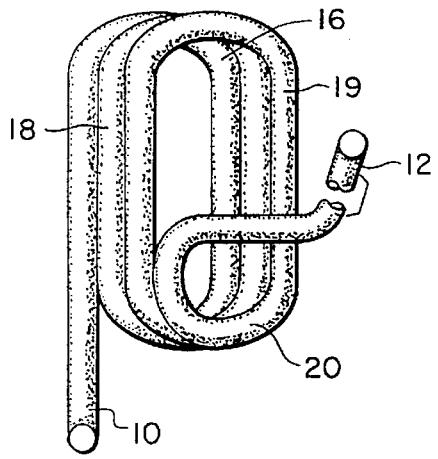
FIG. 6
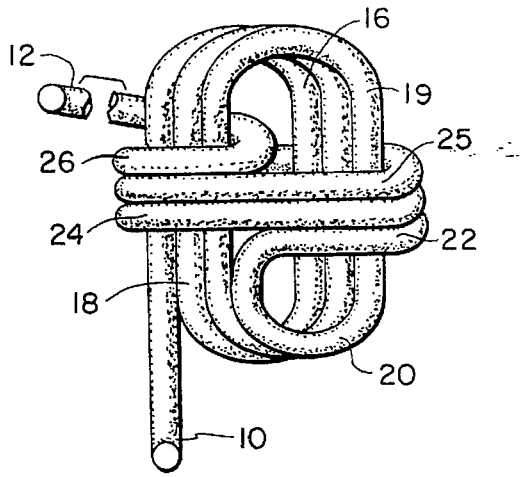
FIG. 7
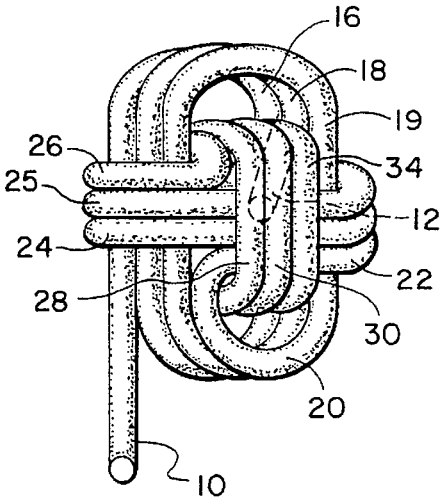
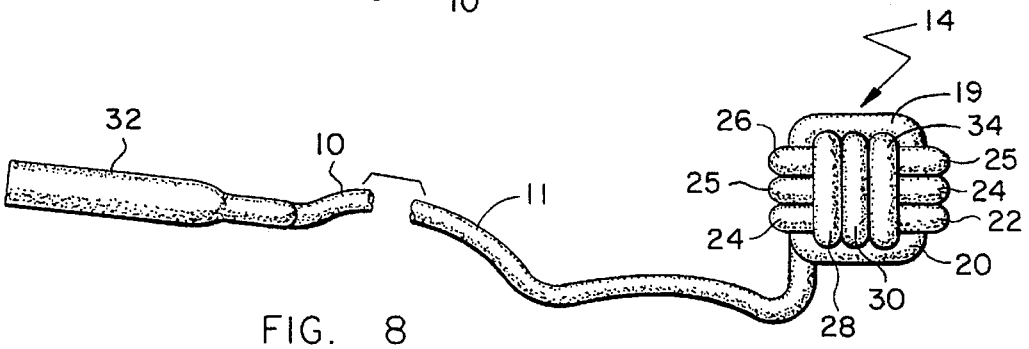
FIG. 8

TOY BALL

BACKGROUND OF THE INVENTION

Anyone who has ever owned a pet knows that pets love to play either alone, with other animals, or with humans. A variety of toys have been marketed in an effort to satisfy the needs of humans and pets to play and the enjoyment that humans have in playing with their pets. These toys also serve the purpose of providing exercise for the pets. Toys for pets and the humans that play with them come in a variety of types and are made from a variety of materials. For example, there are balls of all sizes and shapes, simulated bones, tug toys, etc. that are used in amusing pets and teaching pets to retrieve. All of these toys must be designed so as to avoid injury, and because pets tend to play with pet toys vigorously, most toys used by pets have a relatively short life after considerable pulling and chewing by the animals.

There is therefore a need for an improved toy that can provide amusement, entertainment and exercise for pets, as well as the humans, that play with them. There is a further need for toys that are resistant to rapid destruction and which will not cause injury either to the animal or to humans.

SUMMARY OF THE INVENTION

The toy of the invention is a continuous length of braided rope made of a material that is rot and mildew resistant. One end of the rope is wrapped in a unique way into the shape of a ball with the free end completely hidden inside so that the ball will not unravel during use. The other free end of the cord is relatively long and forms a tail that can be used to spin the ball, throw it, tug it, etc. Preferably, the material used in making the toy is of a material such as polypropylene that not only is rot and mildew resistant, but will also allow the toy to float on water.

BRIEF DESCRIPTION OF THE DRAWING

FIG. 5 is a perspective view illustrating the first step in forming a three-wrap version of the toy;

FIG. 6 is a view similar to FIG. 5 anal showing the second step in forming one end into the shape of a ball;

FIG. 7 is a view similar to FIGS. 5 and 6 and showing the third and final step of forming one end into a ball; and FIG. 8 is a view of the completed three-wrap version of the toy.

DESCRIPTION OF THE PREFERRED EMBODIMENTS OF THE INVENTION

Figure 1:
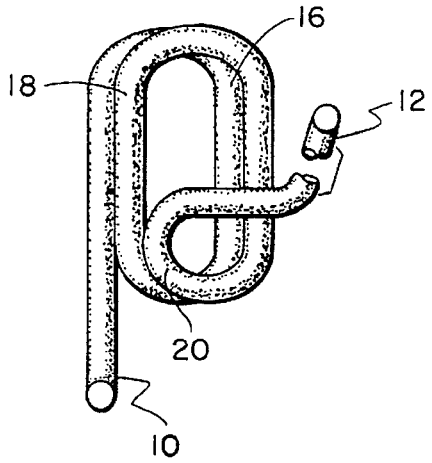
FIG. 1 is a perspective view illustrating the first step in forming a two-wrap version of the toy.
Figure 2:
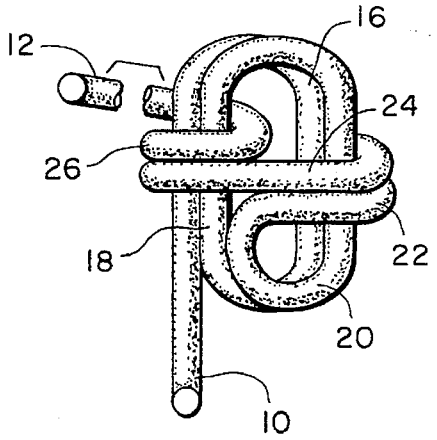
FIG. 2 is a view similar to FIG. 1 and showing the second step in forming one end into the shape of a ball.
Figure 3:
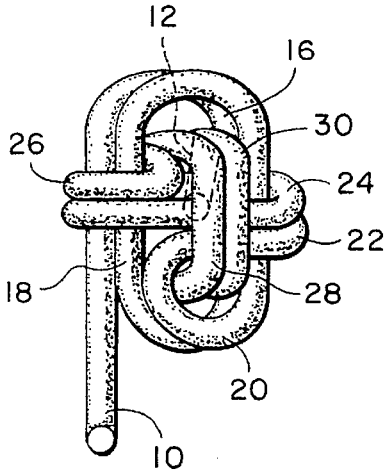
FIG. 3 is a view similar to FIGS. 1 and 2 and showing the third and final step of forming one end into a ball.
Figure 4:
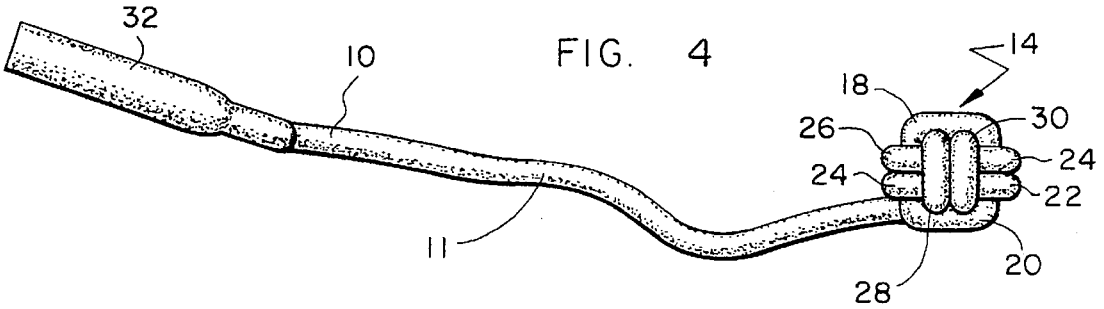
FIG. 4 is a view of the completed two-wrap version of the toy.

FIGS. 1 through 4 of the drawings illustrate the steps in making the toy of the invention in what is termed the two-wrap version. The toy is made from a length of cord or rope, preferably a high-quality braided polypropylene material. This type of material is resistant to both rot and mildew, and it will float. In the two-wrap version illustrated in FIGS. 1 through 4, the toy is made preferably from a length of 27/64" diameter rope of a length of approximately 4½ feet. A first end 10 of the rope is held or otherwise secured with the other free end 12 used to form the ball-shaped portion indicated generally by the reference numeral 14. The rope is grasped between the ends to and 12, and two loops 16 and 18 are formed approximately two feet from the first end 10. A half loop 20 is then formed and the free end 12 passed around and behind the loops 16 and 18 near the center to form a first half transverse loop 22, a full transverse loop 24, and a second half transverse loop 26. The free end 12 is then passed through the loops 16 and 18 so that it extends behind them, and then is passed downwardly around and behind the first half transverse loop 22, the full transverse loop 24, and the second half transverse loop 26 by passing through the half loop 20 to form the first vertical loop 28 and a second vertical loop 30. After forming the second vertical loop 30, the free end of approximately one inch in length is then tucked into the center of all of the loops and the loops tightened to produce the final shape of the ball shown in FIG. 4. When all the loops are tightened to form the finished toy, the first end 10 form a tail 11 which has a length of approximately 17" long. If desired, a wrap 32 may be placed over the first end 10 so as to minimize unraveling and also provide an additional grip and a place for an appropriate label.

FIGS. 5–8 illustrate what is termed the three-wrap version which is identical to the version illustrated in FIGS. 1 through 4 except that three loops are formed in each step rather than two. In other words, in addition to the first and second loops 18, a third loop 19 is formed in the first step shown in FIG. 5. Then, in the second step shown in FIG. 6, an additional full transverse loop 25 is formed, and in the third step illustrated in FIG. 7, a third vertical loop 34 is formed. The finished toy illustrated in FIG. 8 clearly shows the three wraps in each direction that form the ball shaped portion 14.

When completely tightened, the loops of both the two-wrap and three-wrap versions form a ball 14 that is more spherical in shape than that illustrated in the drawings. For purposes of clarity and explanation, the drawings show the loops that form the ball 14 in a more straight condition than when they are completely tightened to form the finished toy.

With the three-wrap version illustrated in FIGS. 5 through 8, it is preferred that the toy be formed from 27/64" diameter rope approximately 6½ feet long, or if formed from ⅝" diameter rope, the starting length of the rope should be approximately 9 feet. This last version will form a rather large ball that can be used for large dogs, for example.

Obviously, using the tail 11, the toy can be swung and thrown with less effort and to a greater distance and height than a traditional ball. In addition, the toy tends to enhance hand/paw-eye coordination. The toy can be used both indoors and outdoors, and can be used for retrieval in water since it will float. Because the toy is made of polypropylene cord, it is resistant to rot and mildew and is almost indestructible. The fibers of the rope will also aid in cleaning and brushing the teeth of an animal that plays with it, and can be easily machine washed and dried. The toy thus has a long life and will provide many hours of entertainment and exercise to those who use it. Because of the construction with the free end tucked inside of the ball, it is virtually impossible to unravel the ball regardless of how many times it is thrown, tugged, chewed, etc. The toy thus provides an inexpensive, long-lasting and beneficial pet toy which humans also enjoy.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. A toy comprising: a continuous length of rope having a first end and a second end, the first end being a free end that forms a tail and the second end being wrapped to form a somewhat ball-shaped portion; the ball-shaped portion being comprised of: two first full loops and a first half loop, the half loop extending around and continuing behind the two first full loops to form a first transverse half loop, a full transverse loop and a second transverse half loop, the second transverse half loop extending through and continuing behind the first full loops and then continuing downwardly around and behind the first transverse half loop the full transverse loop and the second transverse half loop and then through the first half loop to form first and second vertical loops, and the second end being secured in place by extending into the center of the ball shaped portion; all said loops being drawn tightly together to form the ball shaped portion with the first free end forming the tail.

2. The toy of claim 1 in which there are three first full loops, two full transverse loops and three vertical loops.

3. The toy of claim 1 in which the rope is made of polypropylene.

4. The toy of claim 1 in which the rope is made of polypropylene.

* * * * *